US006591946B2

(12) United States Patent
Lauch

(10) Patent No.: US 6,591,946 B2
(45) Date of Patent: Jul. 15, 2003

(54) ADJUSTABLE DOOR RESTRICTOR CABLE FOR AN ELEVATOR CAR

(75) Inventor: Richard Lauch, Hopatcong, NJ (US)

(73) Assignee: Inventio AG, Hergiswil (CH)

( * ) Notice: Subject to any disclaimer, the term of this patent is extended or adjusted under 35 U.S.C. 154(b) by 111 days.

(21) Appl. No.: 09/975,183

(22) Filed: Oct. 11, 2001

(65) Prior Publication Data

US 2003/0070882 A1 Apr. 17, 2003

(51) Int. Cl.[7] ..... B66B 13/16; B66B 13/20

(52) U.S. Cl. ..... 187/309; 187/331; 187/335; 49/120

(58) Field of Search ..... 187/307–310, 187/313, 319, 330, 331, 335; 49/116, 120

(56) References Cited

U.S. PATENT DOCUMENTS

| | | | | |
|---|---|---|---|---|
| 1,399,905 A | * | 12/1921 | Thurston | 187/319 |
| 1,813,734 A | * | 7/1931 | Fried | 187/331 X |
| 2,432,293 A | * | 12/1947 | Di Giovanni | 187/319 |
| 3,744,339 A | | 7/1973 | Martinson | |
| 4,313,525 A | | 2/1982 | McDonald | |
| 4,614,130 A | | 9/1986 | Heismann et al. | |
| 4,934,488 A | * | 6/1990 | Umemura | 187/335 |
| 5,377,785 A | | 1/1995 | Pearson | 187/308 |

FOREIGN PATENT DOCUMENTS

| | | |
|---|---|---|
| EP | 0 634 353 | 1/1985 |

* cited by examiner

*Primary Examiner*—Christopher P. Ellis
*Assistant Examiner*—Thuy V. Tran
(74) *Attorney, Agent, or Firm*—MacMillan, Sobanski & Todd, LLC

(57) ABSTRACT

A door locking system for retrofit installation on an automatic sliding two-panel door of an elevator car prohibits opening and closing of the door from the interior of the car when between two floors. The door locking system includes a hook retainer mounted on one side of the door opening. A locking pawl is mounted to a panel of the door on the opposite side of the opening for selectably engaging the hook retainer. A cable is coupled to a drive mechanism and to the locking pawl for disengaging the locking pawl from the hook retainer when at a floor stop. A flexible cable housing slidably retains the cable and defines a path length between the drive mechanism and the locking pawl. A path length adjuster mechanism is connected between two sections of the cable housing for manually adjusting the path length. A hold-down is mounted to the door to retain the cable housing in close proximity to the door while permitting movement parallel with the door in response to adjustment of the path length.

10 Claims, 4 Drawing Sheets

ADJUSTABLE DOOR RESTRICTOR CABLE FOR AN ELEVATOR CAR

BACKGROUND OF THE INVENTION

The present invention relates in general to elevator doors, and, more specifically, to an adjustable control cable for a door restrictor.

Automatic door systems on elevators must meet a requirement that elevator passengers be unable to open the car door from inside when the elevator car is beyond the door opening zone of a floor. Since regulations associated with this requirement are not very old, there remain very many elevator installations currently without a mechanism to prevent such opening. The door systems of such elevator installations must now be adapted to the present regulations, presenting the problem of updating nonconforming door systems with the smallest possible intrusion into the existing construction while minimizing additional parts and cost.

One solution is shown in U.S. Pat. No. 5,377,785 which is incorporated herein by reference. This patent shows a door locking system for retrofit installation on an automatic sliding door of an elevator car. At floor stops, the car door is coupled via cams and couplings with the hoistway door and is opened and closed together therewith. The locking system prohibits opening of the elevator door from the inside of the car when the car is between two floors (i.e., outside the door opening zone of a floor) by means of a rocker mechanism affixed to a fixed or movable cam of a clutch and coupling mechanism of the door. The rocker mechanism is tilted by coupler brackets of the hoistway door during normal operation of the door within the door opening zone. A cable wire connected between the rocker mechanism and a locking pawl disengages the locking pawl from a hook retainer to mechanically free the door for opening. The rocker mechanism is not actuatable outside of the door opening zone. The locking pawl is kept in a mechanically interlocked position by a compression spring when the rocker mechanism is not actuated, thereby preventing the door from opening.

The cable wire passes through a sheath or housing which creates a certain path length between the rocker mechanism and the locking pawl. For reliability of the locking system, cable stresses need to be kept low. Due to the arrangement of the cable wire, sheath, and locking pawl, actuation of the locking pawl causes the cable wire to bend. A single door locking system often goes through as many as one million locking/unlocking cycles in one year. The repeated sharp bending of the cable wire at a pinch point can lead to premature failure of the cable wire. Cable failure could mean that a door could stay locked even with the elevator car in the door opening zone. Therefore, kinking or potential pinching of the cable wire anywhere between the securing points at its ends should be avoided. Besides setting a path length and constraining the cable wire, the housing protects the cable wire from damage or kinking.

A retainer retains one end of the cable wire at the rocker mechanism. The locking pawl includes an adjusting bolt extending from one end of the pawl arm which retains an eye ring at the other end of the cable wire. Accurate actuation of the pawl mechanism depends on accurate control of the path length determined by the length of the sheath and the actual length of cable wire between the rocker mechanism and the locking pawl. The adjusting bolt on the locking pawl can be retracted or extended to change the effective length of the pawl arm and consequently the leverage of the locking pawl.

However, the adjustment has little effect on the effective length of the cable wire. Therefore, variations in individual dimensions or changes (e.g., stretching) over time cannot be well compensated.

SUMMARY OF THE INVENTION

The present invention has the advantage of making fine adjustments in the disengagement of the locking pawl with a small number of inexpensive parts and reducing stress to the cable.

One aspect of the invention provides a door locking system for retrofit installation on an automatic sliding two-panel door of an elevator car which, at floor stops, is coupled with a hoistway door and is opened and closed together therewith. The locking system prohibits opening and closing of the door from the interior of the car when between two floors, that is, beyond a door opening zone of a floor. A locking pawl is mounted to a panel of the door. A hook retainer is mounted to be adjacent to the locking pawl when the door is closed so that the locking pawl is selectably engaged with the hook retainer. A drive mechanism has an unactivated position when the elevator car is between two floors and is movable to an activated position in response to the elevator car being located in the door opening zone. A cable coupled to the drive mechanism and to the locking pawl for disengaging the locking pawl from the hook retainer when the drive mechanism moves from the unactivated position to the activated position. A flexible cable housing slidably retains the cable and defines a path length between the drive mechanism and the locking pawl. A path length adjuster mechanism is connected between two sections of the cable housing for manually adjusting the path length. A hold-down is mounted to the door to retain the cable housing in close proximity to the door while permitting movement parallel with the door in response to adjustment of the path length.

DETAILED DESCRIPTION OF PREFERRED EMBODIMENTS

Figure 1:
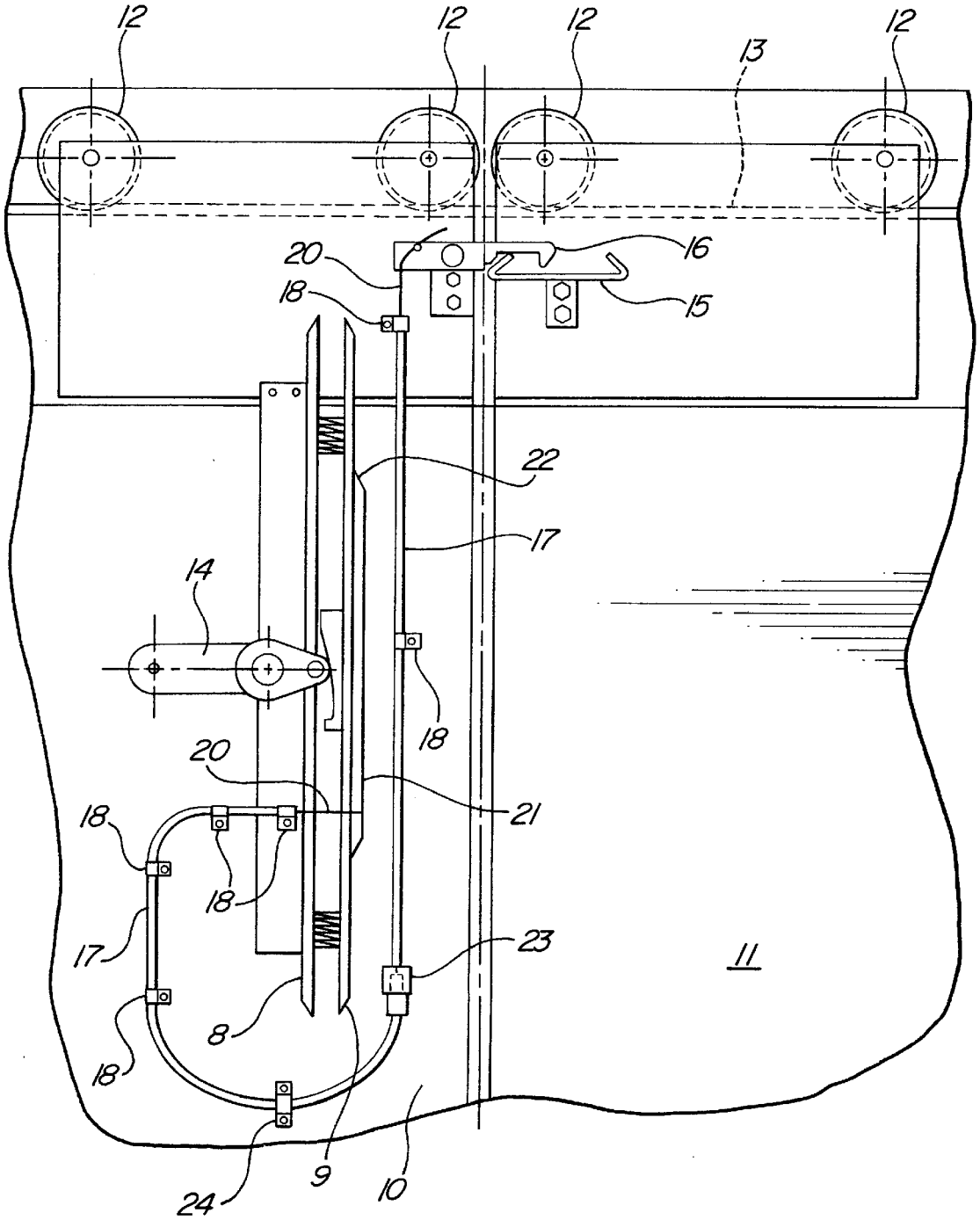
FIG. 1 is a front view of an automatic elevator car door with a retrofit door lock system of the present invention.

FIG. 1 shows a centrally opening elevator sliding door with a left door leaf or half 10 and a right door leaf or half 11. Both door halves 10 and 11 are hung or suspended with rollers 12 which travel on a rail 13 and are opened and closed via a non-illustrated door drive system. Mounted on the left door half or leaf is the clutch and coupling system which is basically comprised of a fixed cam 8, a movable cam 9 and a cam actuator 14. The door locking mechanism installed on this automatic door includes a hook retainer 15 attached at the upper left of the right door half 11, a locking pawl 16 attached at the upper right of the left door half 10 and shown in a locking position, a drawing wire sheath or cable housing 17 which is attached to the left door half 10 with clips or shackles 18, a drawing wire or cable 20 movable within housing 17 and a whip, balance or rocker mechanism 21 which is mounted on movable cam 9 and which activates cable 20. Rocker mechanism 21 includes an inclined surface or facet 22 on both its upper and lower ends.

Although a center-opening two-panel door is shown, the present invention can also be used with side-opening single-panel doors by mounting the hook retainer at a fixed location on the elevator cab.

The present invention achieves an ability to make fine adjustments in the displacement of locking pawl 16 during activation by means of a path length adjuster mechanism 23 and a hold-down bracket 24. These components achieve a variable path length while avoiding additional sources of stress for cable 20. In addition, an improved configuration of locking pawl 16 further reduces stress on cable 20.

Figure 3:
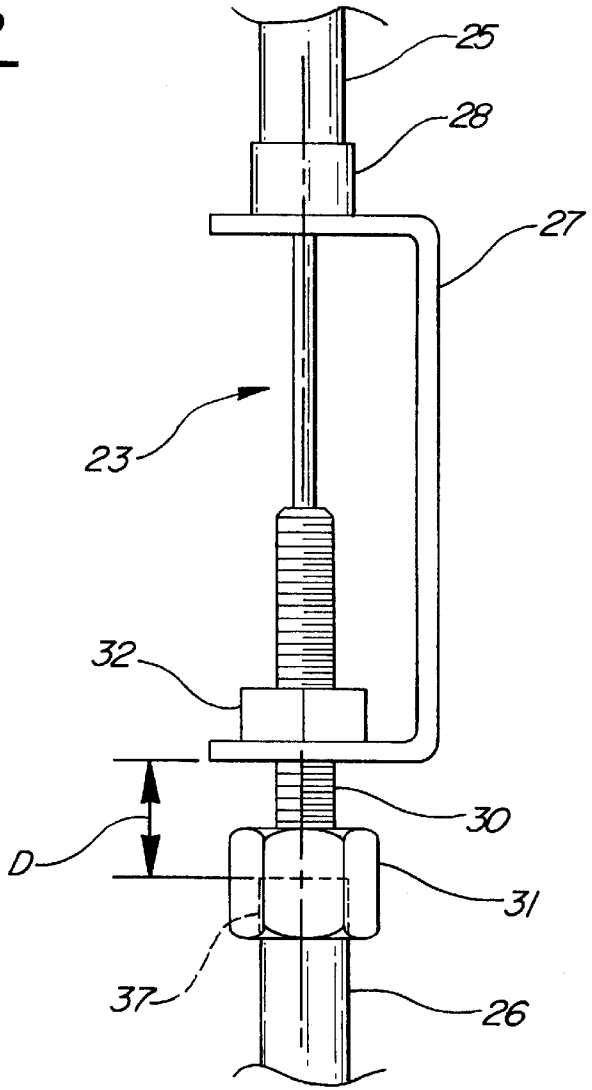
FIG. 3 is a side view of the adjuster mechanism of FIG. 2.
Figure 2:
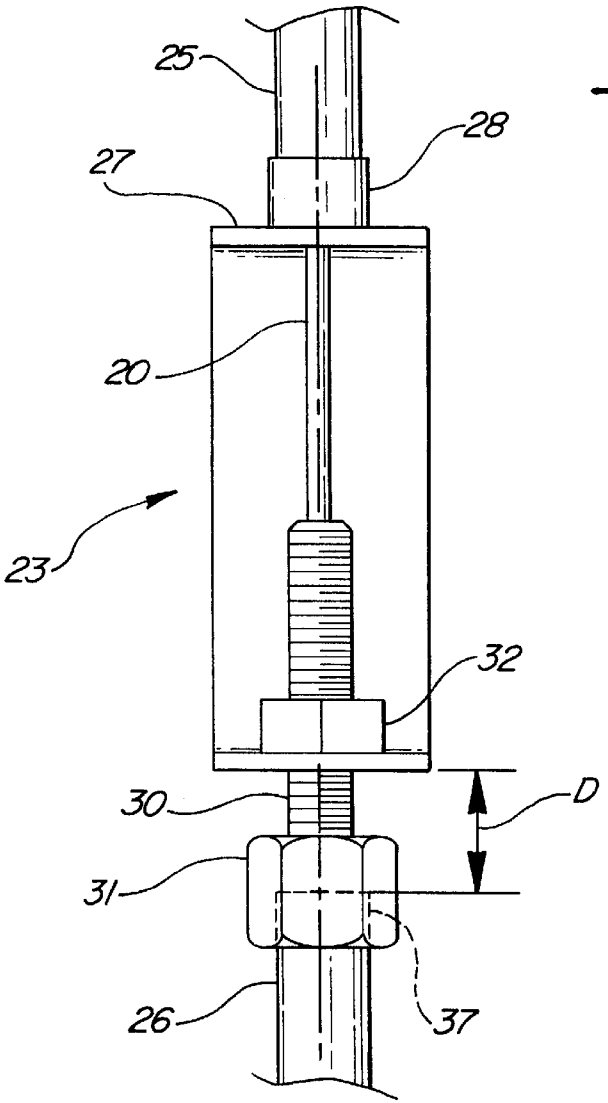
FIG. 2 is a front view of an adjuster mechanism of the present invention.

Referring to FIGS. 2 and 3, cable housing 17 is separated into two sections 25 and 26 and path length adjuster mechanism 23 is inserted between them. A U-bracket 27 has a cylindrically-shaped housing guide 28 on one leg of bracket 27 for fixedly retaining section 25 of cable housing 17. The leg has a hole (not shown) big enough for cable 20 to pass through. At the opposite leg of bracket 27, a threaded passage or nut 32 is fixedly mounted (e.g., welded) to receive a threaded barrel 30. An adjusting head 31 at one end of threaded barrel 30 receives housing section 26. Barrel 30 has a longitudinal bore through which cable 20 passes. Preferably, bracket 27 is mounted to door 10.

The overall path length between the driving end of cable 20 at the rocker mechanism (or equivalently any other driving mechanism such as a cam driven lever or plunger) and the driven end of cable 20 at locking pawl 16 includes the length of housing sections 25 and 26 and the distance between them (which is occupied by path length adjuster mechanism 23). The length of path length adjuster mechanism 23 includes a fixed length of bracket 27 and a variable distance D between bracket 27 and the abutment of housing section 26 with adjusting head 31. Preferably, adjusting hear 31 includes a recess 37 where housing section 26 abuts with adjusting head 31.

Adjusting head 31 has a faceted outer surface (e.g., for grasping by a wrench) to facilitate turning of threaded barrel 30 to slowly increase or decrease length D depending upon the direction in which threaded barrel 30 is turned. Recess 37 loosely holds housing section 26 so that threaded barrel 30 can turn freely. Since other portions of the cable path are fixed, changes in length D cause an inverse change in the length of free cable between the open end of housing section 25 and locking pawl 16. Thus, the engaged/disengaged positioning of locking pawl 16 can be calibrated during either installation or maintenance by manipulating adjusting head 31.

Figure 4:
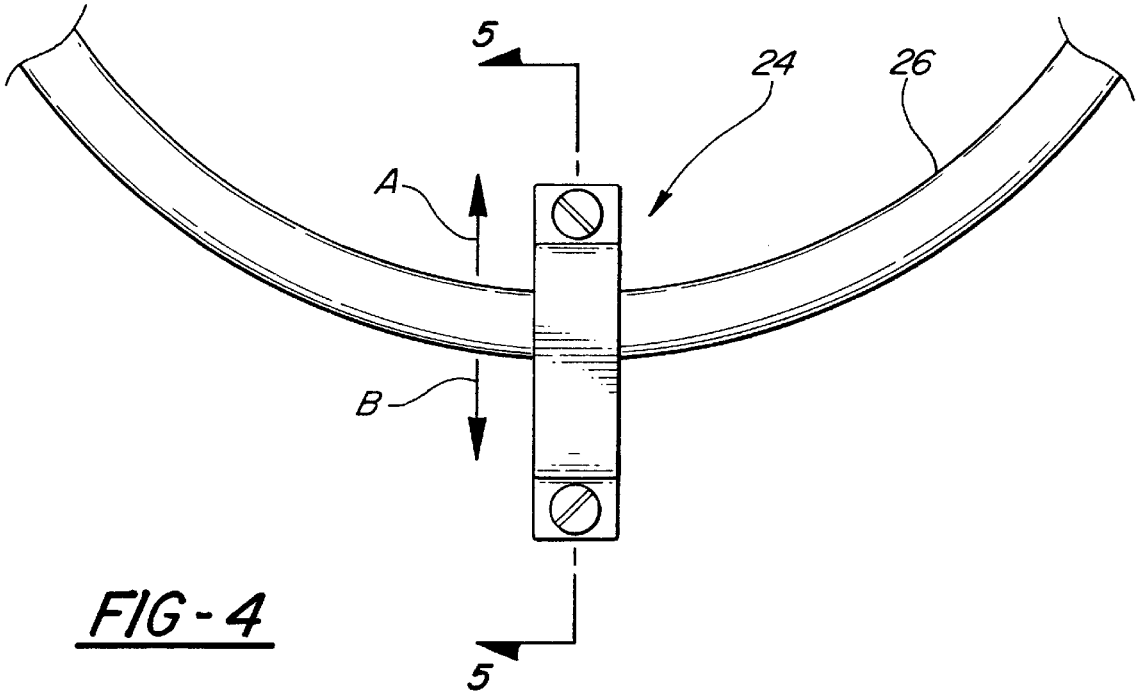
FIG. 4 is a front view of a hold-down bracket for the cable housing of the present invention.
Figure 5:
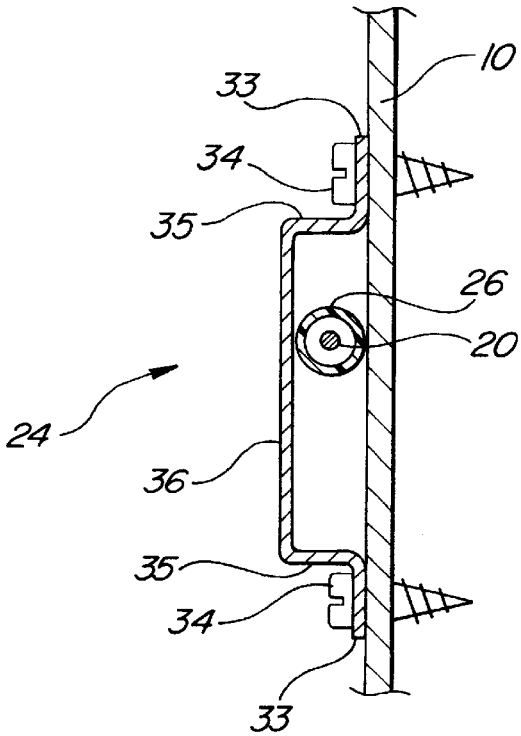
FIG. 5 is a side view of the hold-down bracket of FIG. 4.

Since the path length between the driving end of cable 20 and bracket 27 is variable, housing section 26 must have at least a portion that can move or shift to accommodate changes in path length. Therefore, the lower portion of the housing loop is loosely retained by hold-down bracket 24 as shown in FIGS. 4 and 5 so that housing section 26 can shift vertically in a plane parallel with the door, but it cannot move perpendicularly to the door and consequently interfere with objects in the hoistway.

Bracket 24 includes flat mounting sections 33 joined to door 10 by screws 34. A pair of transverse sections 35 are connected by a vertical section 36 and have a length just slightly greater than the outside diameter of housing section 26 so that the housing can freely move in a vertical direction. Bracket 24 is positioned on door 10 to provide a range of upward and downward movement corresponding to the adjustment range of threaded barrel 30. When adjusting head 31 is turned for increasing insertion into bracket 27 (e.g., clockwise), then cable housing section 26 shifts upward as indicated by arrow A in FIG. 4, reducing the path length and allowing the hook on one end of locking pawl 16 to move farther into hook retainer 15. On the other hand, when threaded barrel 30 is retracted from bracket 27, then path length is increased, housing section moves downward in the direction of arrow B, and the hook on locking pawl 16 moves away from hook retainer 15.

Figure 6:
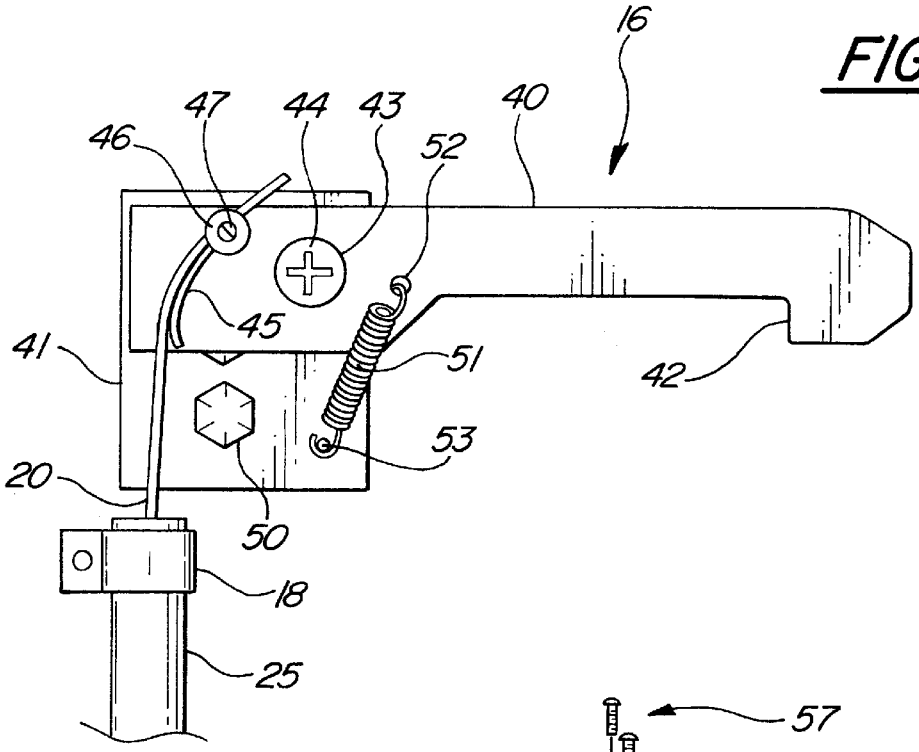
FIG. 6 is a front view of a locking pawl of the present invention.

Locking pawl 16 is shown in greater detail in FIG. 6 and includes a lever arm 40 and a base 41 mounted to door 10 by bolts or screws 50. Lever arm 40 has a locking hook 42 at one distal end and has a pivot hole 43 receiving a pivot pin 44 mounted on base 41. Lever arm 40 can be retained on pivot pin 44 by staking or by a screw and rotating washer, for example.

Cable 20 exits housing section 25 and is routed over a curved bearing surface 45 formed as a ridge protruding from lever arm 40. Cable 20 is secured to lever arm 40 by a locking washer 46 and screw 47 beyond the end of bearing surface 45 to ensure that cable 20 is supported against bearing surface 45 at all times.

In a preferred embodiment, bearing surface 45 and the end termination of cable housing section 25 are mounted such that cable 20 exits housing 25 in direct alignment with bearing surface 45. Furthermore, the curvature of bearing surface 45 is designed to keep cable 20 coming straight out of housing section 25 at all rotational positions of lever arm 40. In other words, as bearing surface 45 rotates, a tangent to the curved surface at the point where cable 20 lifts off of curved surface 45 is always vertical and stays substantially aligned with the termination of housing section 25. For example, if the center of curvature coincides with the axis of rotation (i.e., pivot pin 44), then the curvature would be an arc of a circle. For a more compact design, the center of curvature can be moved away from pivot pin 44 resulting in a more elliptical curvature of bearing surface 45 as shown in FIG. 6. In either case, stress in cable 20 is greatly reduced and reliability is increased since there is no kinking of cable 20 at any point.

Lever arm 40 is biased against the action of cable 20 and into a position where locking hook is pulled downward into the hook retainer by an extension spring 51. One end of spring 51 is captured in a hole 52 in lever arm 40 and the other end of spring 51 grasps a peg 53 projecting from base 41. A torsion spring or other placements of an extension spring or a compression spring could also be used.

Figure 7:
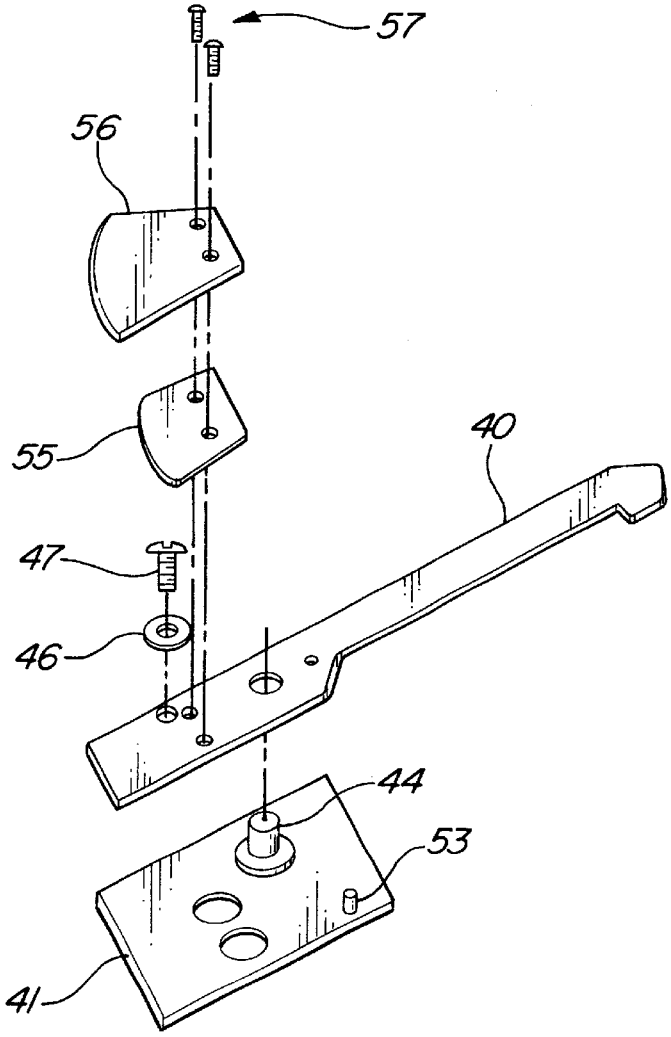
FIG. 7 is an exploded perspective view of an alternative embodiment of the locking pawl.

FIG. 7 shows an alternative embodiment of locking pawl 16. The bearing surface is provide by a guide plate 55 which is mounted between lever arm 40 and a retainer plate 56 using a pair of bolts 57. Retainer plate 56 extends axially beyond guide plate 55 to keep cable 20 from slipping off of the bearing surface.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A door locking system for retrofit installation on an automatic sliding two-panel door of an elevator car which, at floor stops, is coupled with a hoistway door and is opened and closed together therewith, wherein said locking system prohibits opening and closing of said door from the interior of said car when between two floors, that is, beyond a door opening zone of a floor, said door locking system including:

a locking pawl mounted to one panel of said door;

a hook retainer mounted to be adjacent to said locking pawl when said door is closed, said locking pawl being selectably engaged with said hook retainer;

a drive mechanism having an unactivated position when said elevator car is between two floors and movable to an activated position in response to said elevator car being located in said door opening zone;

a cable coupled to said drive mechanism and to said locking pawl for disengaging said locking pawl from said hook retainer when said drive mechanism moves from said unactivated position to said activated position;

a flexible cable housing slidably retaining said cable and defining a path length between said drive mechanism and said locking pawl;

a path length adjuster mechanism connected between two sections of said cable housing for manually adjusting said path length; and a hold-down mounted to said door to retain said cable housing in close proximity to said door while permitting movement parallel with said door in response to adjustment of said path length.

2. The door locking system of claim 1 wherein said locking pawl is comprised of:

a pivot pin;

a locking hook;

a curved bearing surface for receiving said cable;

a cable fastener for retaining an end of said cable such that said cable bears against said curved bearing surface; and a biaser for urging said locking hook into engagement with said hook retainer.

3. The door locking system of claim 2 wherein said cable bears against said curved bearing surface at all times.

4. The door locking system of claim 2 wherein said cable housing has a termination substantially directly aligned with a tangent at a near end of said curved bearing surface.

5. The door locking system of claim 4 wherein said curved bearing surface is shaped such that as said locking pawl moves between being engaged and disengaged, a tangent to said curved bearing surface at each point where said cable lifts off of said curved bearing surface during said movement stays substantially aligned with said termination of said cable housing.

6. The door locking system of claim 2 wherein said biaser is comprised of a spring.

7. The door locking system of claim 1 wherein said hold-down is comprised of a bracket.

8. The door locking system of claim 1 wherein said hold-down is mounted over said cable housing between said drive mechanism and said path length adjuster mechanism.

9. The door locking system of claim 1 wherein said path length adjuster mechanism is comprised of:

a threaded barrel having an interior bore receiving said cable and having a collar receiving one of said sections of said cable housing; and an adjustment bracket receiving the other one of said sections of said cable housing at one end and receiving said threaded barrel in a threaded passage at an opposite end.

10. A door locking system for retrofit installation on an automatic sliding two-panel door of an elevator car which, at floor stops, is coupled with a hoistway door and is opened and closed together therewith, wherein said locking system prohibits opening and closing of said door from the interior of said car when between two floors, that is, beyond a door opening zone of a floor, said door locking system including:

a locking pawl mounted to one panel of said door;

a hook retainer mounted to be adjacent to said locking pawl when said door is closed, said locking pawl being selectably engaged with said hook retainer;

a drive mechanism having an unactivated position when said elevator car is between two floors and movable to an activated position in response to said elevator car being located in said door opening zone;

a cable coupled to said drive mechanism and to said locking pawl for disengaging said locking pawl from said hook retainer when said drive mechanism moves from said unactivated position to said activated position;

a flexible cable housing slidably retaining said cable and defining a path length between said drive mechanism and said locking pawl; and wherein said locking pawl is comprised of:

a pivot pin;

a locking hook;

a curved bearing surface for receiving said cable;

a cable fastener for retaining an end of said cable such that said cable bears against said curved bearing surface; and a biaser for urging said locking hook into engagement with said hook retainer.

* * * * *